United States Patent [19]

Hirschle

[11] 4,137,967

[45] Feb. 6, 1979

[54] STEAM GENERATOR

[75] Inventor: Georg Hirschle, Winterthur, Switzerland

[73] Assignee: SGX Sulzer-General Atomic Warmetauscher Aktiengesellschaft, Winterthur, Switzerland

[21] Appl. No.: 732,351

[22] Filed: Oct. 14, 1976

[30] Foreign Application Priority Data

Sep. 1, 1976 [CH] Switzerland ..... 11055/76

[51] Int. Cl.[2] ..... F28F 5/00

[52] U.S. Cl. ..... 165/162; 122/510; 176/87

[58] Field of Search ..... 176/87; 122/510; 165/163

[56] References Cited

U.S. PATENT DOCUMENTS

| | | | |
|---|---|---|---|
| 2,983,260 | 5/1961 | Huet | 122/510 |
| 3,346,043 | 10/1967 | Thurnauer | 122/510 |
| 3,509,939 | 5/1970 | Weber | 122/510 |
| 3,527,261 | 9/1970 | Bigler et al. | 122/510 |
| 3,951,108 | 4/1976 | Rees | 122/510 |

*Primary Examiner*—Charles J. Myhre
*Assistant Examiner*—Theophil W. Struele, Jr.
*Attorney, Agent, or Firm*—Kenyon & Kenyon, Reilly, Carr & Chapin

[57] ABSTRACT

The expansion pipe loops which connect the tubes of the heat exchanger to the discharge lines are suspended via double-armed levers which are movably secured at the ends to the mounting system and anchoring system. The points on the pipe loops which are connected to the fulcrum of the respective levers as well as the fulcrums are chosen so as to render the stresses in the pipe loops as low as possible and approximately equal on both sides of the pivots. Pairs of levers with an interconnecting support beam are used to suspend a plurality of the pipe loops in common.

4 Claims, 6 Drawing Figures

STEAM GENERATOR

This invention relates to a steam generator and, particularly, to a steam generator for a nuclear power plant. More particularly, this invention relates to a pipe suspension system for a steam generator of a nuclear power plant.

Heretofore, nuclear power plants have been known to have a multiplicity of tubes of a heat exchanger mounted in a mounting system which is independent of an anchoring system in which supply lines and discharge lines for the tubes are mounted. In such cases, the mounting system shifts relative to the anchoring system when the plant is in use due to differences in temperature the two systems, i.e. due to thermal expansion. This shifting is particularly severe where the tubes of the heat exchanger are very long. Accordingly, in order to compensate for this shifting, connecting pipes in the form of expansion loops have been employed between the tubes and the supply and/or discharge lines.

However, these pipe loops may, in some cases, be of considerable length so that they have a relatively large sag due to their weight and are highly stressed, particularly in the vicinity of their fixation points.

Accordingly, it is an object of the invention to reduce the stresses in the expansion pipe loops of a steam generator of the above type to a permissible level without affecting the mobility of the mounting and anchoring systems in shifting relative to each other.

It is another object of the invention to provide a simple means of reducing stresses due to thermal expansion between a mounting system and an anchoring system of a steam generator.

Briefly, the invention is directed to a steam generator which comprises a mounting system, a heat exchanger which includes a multiplicity of tubes suspended in the mounting system, an anchoring system, and a plurality of supply lines and discharge lines mounted in the anchoring system for supplying and discharging a working medium to and from the tubes of the heat exchanger. In addition, a plurality of expansion pipe loops connect the tubes to the supply and/or discharge lines while a means is provided to support the pipe loops in suspended manner.

The means for supporting the pipe loops includes at least one double-armed lever which is movably secured at each end to a respective one of the mounting system and anchoring system. The lever has a fulcrum which supports a point of at least one pipe loop. Both this point and the fulcrum on the lever are so located that the maximum stresses on the pipe loop on both sides of the point are approximately equal and as low as possible independently of the state of expansion, i.e. independently of the prevailing temperature, of the mounting system and the anchoring system to each other.

In this manner, each pipe loop is supported in at least one and particularly at several points along its length and is lifted by a certain amount as compared to a free sag. The connection to the two mutually shifting systems via movable, e.g. hinged, levers ensure an uninhibited yielding to occurring thermal expansion.

The position of the support points along the free length of the pipe loop and that of the fulcrum on the length of the lever can be freely chosen within certain limits and thereby, the suspension point of the pipe loop at the lever. The free choice of this suspension point at the lever allows the amount by which the pipe loop is lifted or displaced as to be varied within certain limits compared to a free sag. The places and points mentioned are chosen by a method which will be described later so that the stresses that occur in the pipe loops are minimized independently of the state of expansion, i.e. the temperature of the pipe loop, and are made equal on both sides of the respective support point as far as possible.

In case of a multiplicity of pipe loops, the support means can be simplified considerably if the points of different pipe loops of equal desired displacement, i.e. points of different pipe loops which are lifted by the same amount at the support point considered, are connected to each other via a support beam, and if this support beam is suspended at the fulcrum of at least one double-armed lever.

In addition, it is advantageous if the ends of the double-armed lever are each fastened in the mounting and anchoring systems via a strap.

These and other objects and advantages of the invention will become more apparent from the following detailed description and appended claims taken in conjunction with the accompanying drawings in which:

Figure 1:
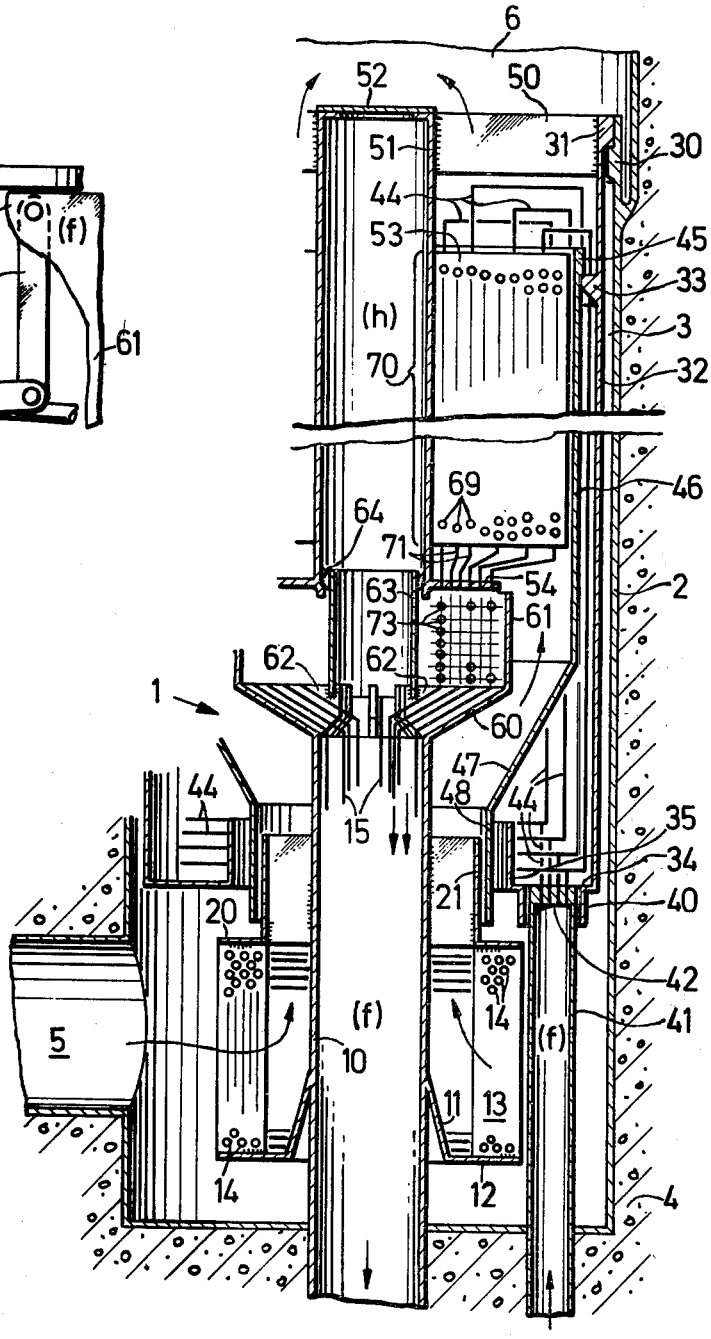
FIG. 1 illustrates a vertical cross section through a heat exchanger of a nuclear power plant consisting of a steam generator and a reheater in accordance with the invention.

Referring to FIG. 1, the steam generator employs a heat exchanger system 1 which is mounted in a chamber 3, which has the shape of a circular cylinder and is lined with a sheet metal lining 2. The chamber 3 is located in a concrete pressure tank 4 which is part of a nuclear power plant and is supplied with hot gas via a connection line 5 from a reactor core (not shown), for example, by a circulating blower (not shown). The gas flows back from an upper portion 6 of the chamber 3 to the reactor core (not shown) after being cooled within the chamber 3.

A central pipe 10 passes through the bottom of the chamber 3 and supports a support plate 12 in a suspended manner via a cone 11. The support plate 12, in turn, supports radial perforated plates 13 into which heat exchanger tubes 14 are rolled. The tubes 14, which together form a ringshaped pipe, are connected at the ends to two inlet and outlet plenums (not shown). The upper ends of the tube plates 13 are connected to a washer 20 which supports a collar 21. The elements 10 to 13, 20 and 21 form, together with the parts 60 to 63 described later, a system, designated as an "anchoring system" (f).

A mounting system (h) for a heat exchanger 70 is disposed above the anchoring system (f). This mounting system is supported on the sheet metal lining 2 via an inner flange 30 and includes a shroud 32 which has an outer flange 31 at the top which rests on the inner flange 30 of the lining 2. The shroud 32 also has an inner flange 33 and a ringshaped bottom 34 with a collar 35 below the flange 33. A stub 40 is provided in the bottom 34 into which the upper end of an axially movable feed water distributor 41 is led. In addition, a shroud 46 is located within the shroud 32 and rests via an outer flange 45 on the inner flange 33. This shroud 46 merges at the bottom into a cone 47 and a cylindrical guide section 48 about the collar 21.

Spokes 50 are welded to the shroud 32 in the vicinity of the flange 31 and are connected to an inner pipe 51 which is closed off by a cover 52 at the top. The spokes 50 carry radially placed perforated plates 53 via suspensions (not shown) as well as a support ring 54 via the inner pipe 51.

The heat exchanger 70 also has a multiplicity of helically bent tubes 69 rolled into the perforated plates 53 so as to be suspended in the mounting system (h). This heat exchanger 70 is fed via supply lines 44 which start from a tube sheet 42 of the distributor 41, are distributed over the circumference in the annular space between the collar 35 and the shroud 32, rise through the gap between the shroud 32 and the inner shroud 46, penetrate the flange 33, and are connected to the tubes 69 of the helix heat exchanger 70 from above. These supply lines 44 are mounted in the anchoring system and serve to supply a working medium to the tubes 69.

The tube sheet 42 is a further, independent part of the anchoring system (f), which comprises the supply lines 44 to the heat exchanger 70. The connection of the lines 44 to the tubes 69 of the heat exchanger 70 is not a subject of the invention and will therefore not be described in detail. However, it is noted that the sections of the supply lines 44 which extend from the distributor 41 to the flange 33 and carry feed water need to take up only small expansion differences which do not cause appreciable stresses.

Figure 2:
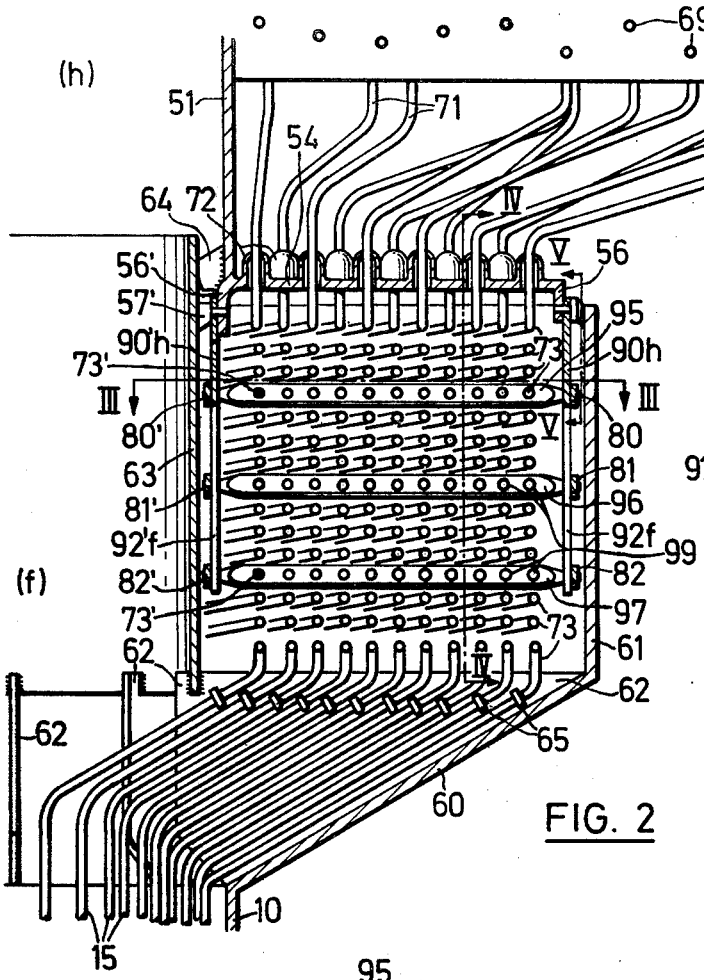
FIG. 2 illustrates an enlarged fractional view of the steam generator of FIG. 1 which corresponds to a cross section II—II of FIGS. 3 and 4.
Figure 4:
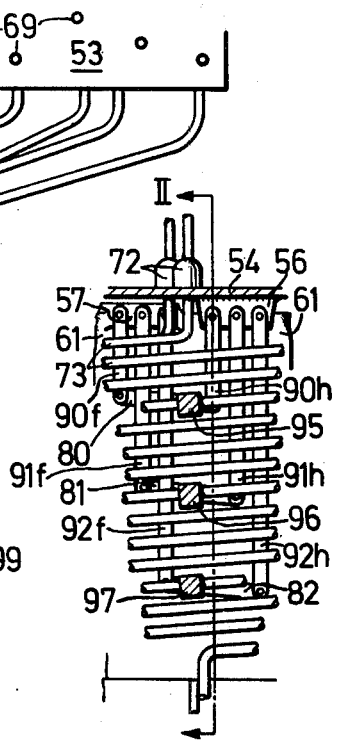
FIG. 4 illustrates a vertical cross-section IV—IV of FIG. 2.
Figure 3:
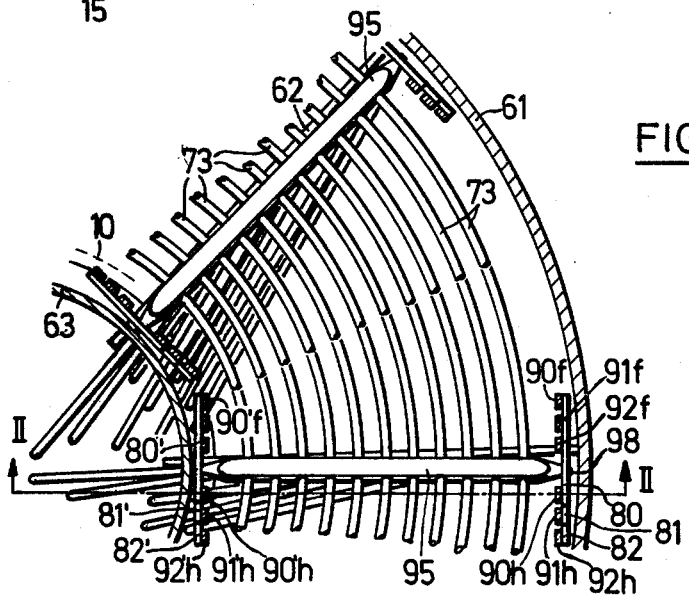
FIG. 3 illustrates a horizontal cross section III—III of FIG. 2.

Referring to FIGS. 1 and 2, the central pipe 10 is flared at the upper end to form a cone 60 which is continued as a sheet metal cylinder 61. Eight radially disposed standing support plates 62 are mounted on the cone 60 and are fastened at the inner regions to a pipe section 63 secured coaxially with the central pipe 10. This pipe section 63, which is part of the anchoring system (f), is guided via guide pieces 64 in the inner pipe 51 which belongs to the mounting system (h) should the system h, f shift relative to each other.

The exit ends of the tubes 69 of the heat exchanger 70 are connected via short pipe loops 71 to penetration sleeves 72 (FIG. 2) in the support ring 54, where they are connected to a plurality of expansion pipe loops 73. These pipe loops 73 run in a bent helical manner in the annular space between the cone 60, the sheet metal cylinder 61, the support ring 54 and the pipe section 63. The loops 73 are then fastened by means of clamps 65 to the radially standing support plates 62 and, thereafter, run inward at an incline and thence descend to discharge tubes 15 through the central pipe 10 to the tube sheets (not shown) of a collector. The discharge tubes 15 which are mounted in the anchoring system discharge the working medium from the tubes 69.

Figure 6:
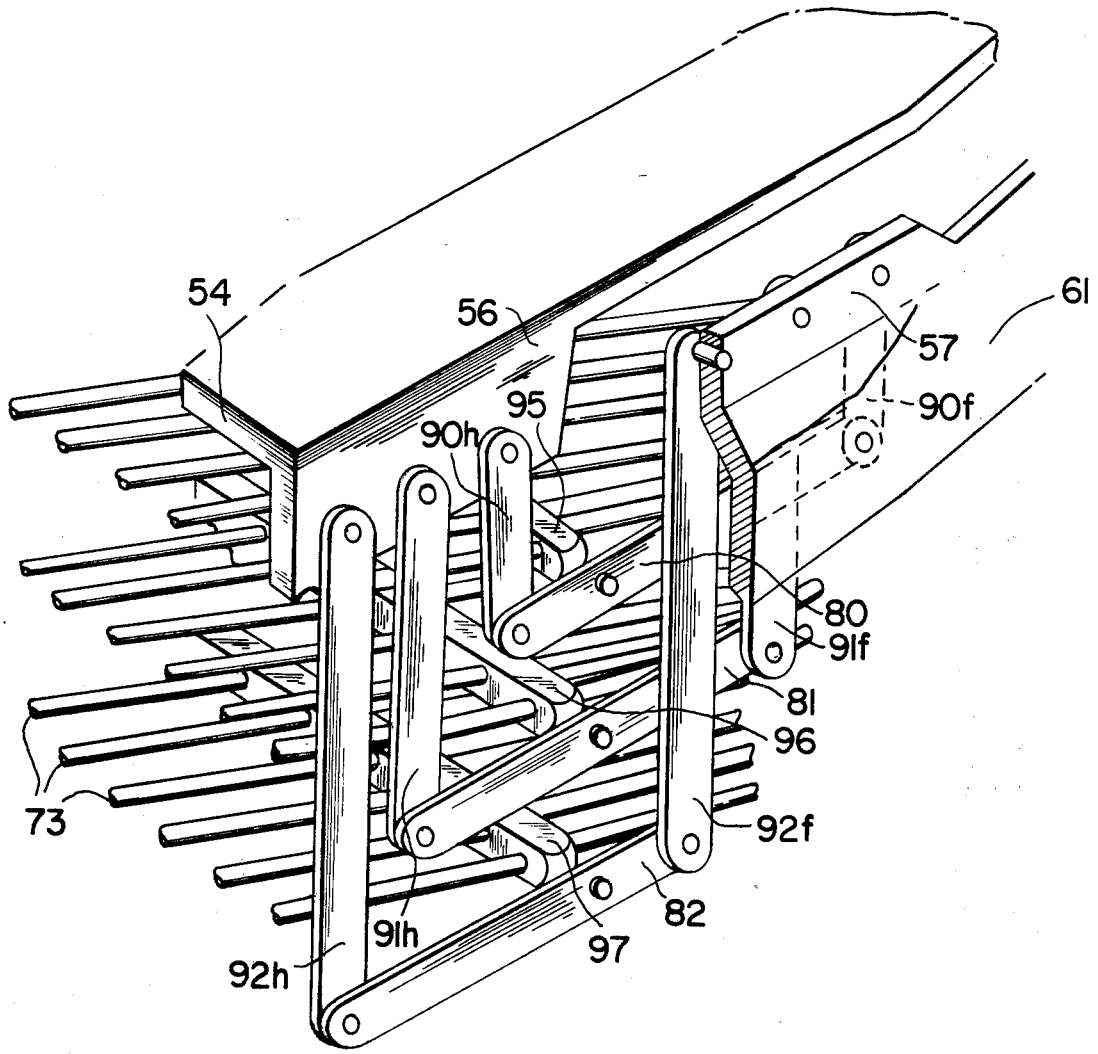
FIG. 6 illustrates an enlarged perspective view of a beam to tube support and lever mounting system in accordance with the invention.

In contrast to the displacements of the supply lines 44 extending from the distributor 41 to the flange 33, there are relatively large distance changes between the support plates 62 of the anchoring system and the support ring 54 of the mounting system due to the considerable thermal expansions of the heat exchangers 70 which are compensated by the helical pipe loops 73. As the helical pipe loops 73 have considerable length in the circumferential direction and are disposed in an approximately horizontal plane, the loops 73 are stressed in flexure by their own weight, unless they are otherwise supported. To this end, a means for supporting the pipe loops 73 in suspended manner is provided. This support or suspension system (FIGS. 2 and 6) consists of double-armed levers 80, 81, 82 which are suspended at the outer periphery of the loops 73 via straps 90*h*, 91*h* and 92*h* on respective flanges 56 which are fastened to the support ring 54 of the mounting system (h), and to straps 90*f*, 91*f* and 92*f* which are, in turn, connected to a suspendor 57 fastened to the annular jacket 61 of the anchoring system (f). Analogous double-armed levers 80', 81' and 82', designated with a prime ('), straps 90'*h*, 91'*h* and 92'*h*; 90'*f*, 91'*f* and 92'*f* as well as flanges 56' at the support ring 54 and suspendors 57' at the pipe section 63 are arranged on the inside of the annular space between the cylinder 61 and the pipe section 63.

Figure 5:
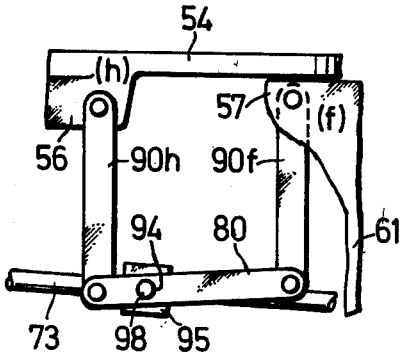
FIG. 5 illustrates a greatly simplified cross section V—V of FIG. 2 on an enlarged scale.

Referring to FIG. 5, each double-armed lever 80 to 82 and 80' to 82' has a horizontal hole 94 between the point at which they are suspended by the straps 90*h* to 92*h* and 90*f* to 92*f* as well as 90'*h* to 92'*h* and 90'*f* to 92'*f*. This hole 94 serves as a fulcrum for the lever 80. Each pair of levers 80/80', 81/81' and 82/82' as shown in FIG. 2 carries a cross beam or support beam 95, 96, 97. To this end, each cross beam 95, 96, 97 has a pin 98 at each end received in a hole 94 of the respective lever. Each of the cross beams 95 to 97 also has 11 cross holes 99, in which the pipe loops 73 are secured.

Each pipe loop 73 is supported by the support beams 95, 96 and 97 at three points such that the beams 95, 96, 97 divide each loop 73 into four approximately equal parts between the penetration sleeve 72 and the clamps 65. Each loop 73' marked by a solid circle is supported, for instance, by the beams 95 and 97 on the side shown of the heat exchanger, while the third support point of this loop 73' is in the beam 96 which is disposed symmetrically to the beam 96 shown in the plane shown in FIG. 2 beyond the symmetry plane passing through the axis of rotation.

While the holes 94 of the levers 81 and 81' are located at about half the length of these levers and support approximately the center of the originally free length of the respective pipe loop 73, those of the levers 80 and 80' divide the distance between the straps 90*h* and 90*f* as well as 90'*h* and 90'*f* in a ratio which is equal to or smaller than 1:3, depending on the stiffness of the clamping of the pipe loop 73 in the penetration sleeves 72 and the clamps 65. This ratio is chosen so that the maximum stresses at the pipe loops 73 on both sides of the cross beams 95 to 97 are as small as possible and approximately equal. Accordingly, this ratio becomes conversely equal to or smaller than 3:1 at the levers 82 and 82'.

In order to obtain a rough empirical determination of the division ratio of the lever length, a pipe loop 73 is clamped normally in the sleeves 72 and under the clamps 65 but is otherwise not supported. The loop 73 is then suspended by soft springs at the support points in such a manner that its weight is just balanced. Subsequently, the support ring 54 is moved vertically relative to the support plates 62 by a given amount, and the movements of the support points, which occur therewith, are measured. The division ratios can then be determined by simple calculation from the relative displacement between the ring 54 and the plates 62 and the movements at the support points then measured.

The determination of the division ratios can be refined by known methods of stress analysis, by introducing into the calculation the forces and moments acting on the pipe loops 73 and determining the shifts of the bending lines with the smallest maximum stresses.

This method was carried out here at different temperatures, selecting for this purpose empirically those temperatures at which maximum displacements of the two systems (h) and (f), and therefore, the greatest bending stresses at the clamped pipe loops 73 occur. Depending on the stiffness of the clamping at the clamping points 72 and 65, it may be advantageous to choose the support points at the pipe loops 73 differently in order to obtain optimum stress conditions.

What is claimed is:

1. In a steam generator, the combination comprising a mounting system, a heat exchanger including a multiplicity of tubes suspended in said mounting system, an anchoring system, a plurality of supply lines mounted in said anchoring system for supplying a working medium to said tubes, a plurality of discharge lines mounted in said anchoring system for discharging the working medium from said tubes, a plurality of expansion pipe loops connecting said tubes to at least one of said supply lines and said discharge lines, and means supporting said pipe loops in suspended manner, said means including at least one double-armed lever movably secured at each respective end to a respective one of said mounting system and said anchoring system and having a fulcrum supporting a point of at least one pipe loop, said point being located on said pipe loop and said fulcrum being located on said lever whereby the maximum stresses on said pipe loop on both sides of said point are approximately equal and as low as possible independently of the state of expansion of said mounting system and said anchoring system to each other.

2. The combination as set forth in claim 1 wherein said means includes a support beam secured to a plurality of said pipe loops at points of equal displacement and to said fulcrum of said lever.

3. The combination as set forth in claim 1 wherein said means further includes a strap at each end of said lever securing said lever to a respective one of said mounting system and said anchoring system.

4. In a steam generator, the combination comprising a mounting system, a heat exchanger including a multiplicity of tubes suspended in said mounting system, an anchoring system, a plurality of supply lines mounted in said anchoring system for supplying a working medium to said tubes, a plurality of discharge lines mounted in said anchoring system for discharging the working medium from said tubes, a plurality of expansion pipe loops connecting said tubes to at least one of said supply lines and said discharge lines, and means supporting said pipe loops in suspended manner, said means including a plurality of spaced apart support beams, each said support beam being secured to a plurality of pipe loops at points of equal displacement of said pipe loops, and a plurality of double-armed levers, each lever being movable secured at a respective end to a respective one of said mounting system and said anchoring system and having a fulcrum secured to a respective end of a respective support beam.

* * * * *

UNITED STATES PATENT AND TRADEMARK OFFICE

CERTIFICATE OF CORRECTION

PATENT NO. : 4,137,967

DATED : February 6, 1979

INVENTOR(S) : Georg Hirschle

It is certified that error appears in the above-identified patent and that said Letters Patent are hereby corrected as shown below:

Column 1, line 16, after "temperature" insert --between--

Signed and Sealed this

*Eleventh* Day of *September 1979*

[SEAL]

*Attest:*

*Attesting Officer*

LUTRELLE F. PARKER

*Acting Commissioner of Patents and Trademarks*